US008275290B2

(12) United States Patent
Ishii

(10) Patent No.: US 8,275,290 B2
(45) Date of Patent: Sep. 25, 2012

(54) ELECTROPHOTOGRAPHIC PHOTOSENSITIVE BODY AND IMAGE FORMING APPARATUS PROVIDED WITH THE SAME

(75) Inventor: Yoshinobu Ishii, Higashiomi (JP)

(73) Assignee: Kyocera Corporation, Kyoto (JP)

( * ) Notice: Subject to any disclaimer, the term of this patent is extended or adjusted under 35 U.S.C. 154(b) by 483 days.

(21) Appl. No.: 12/525,522

(22) PCT Filed: Jan. 28, 2008

(86) PCT No.: PCT/JP2008/051200

§ 371 (c)(1),
(2), (4) Date: Dec. 7, 2009

(87) PCT Pub. No.: WO2008/093634

PCT Pub. Date: Aug. 7, 2008

(65) Prior Publication Data

US 2010/0183331 A1 Jul. 22, 2010

(30) Foreign Application Priority Data

Jan. 31, 2007 (JP) ..... 2007-020561

(51) Int. Cl.
*G03G 15/00* (2006.01)

(52) U.S. Cl. ..... 399/159; 399/26; 399/116

(58) Field of Classification Search ..... 399/26, 399/116, 159

See application file for complete search history.

(56) References Cited

U.S. PATENT DOCUMENTS

| | | | | |
|---|---|---|---|---|
| 5,534,980 | A * | 7/1996 | Tanaka | 399/168 |
| 5,631,727 | A * | 5/1997 | Ehara et al. | 399/131 |
| 7,498,110 | B2 | 3/2009 | Taniguchi et al. | 430/67 |
| 2005/0238976 | A1 | 10/2005 | Taniguchi et al. | 430/66 |
| 2007/0154239 | A1 | 7/2007 | Fukunaga et al. | 399/159 |
| 2007/0177897 | A1 | 8/2007 | Ishii | 399/159 |

FOREIGN PATENT DOCUMENTS

| | | |
|---|---|---|
| JP | 02-029662 | 1/1990 |
| JP | 05-011209 | 1/1993 |
| JP | 11-002943 | 1/1999 |
| JP | 2005-301233 | 10/2005 |
| JP | 2007-199669 | 8/2007 |
| JP | 2007-226203 | 9/2007 |

* cited by examiner

*Primary Examiner* — Walter L Lindsay, Jr.
*Assistant Examiner* — Roy Y Yi
(74) *Attorney, Agent, or Firm* — DLA Piper LLP (US)

(57) ABSTRACT

An electrophotographic photosensitive body includes a substrate and a photosensitive layer. In the electrophotographic photosensitive body, a reflectance to an exposure light $L_1$ is defined as a first reflectance, and a reflectance of an eliminating light is defined as a second reflectance. The first reflectance is positively correlated with a light intensity rate of the exposure light $L_1$, and the second reflectance is positively correlated with the light intensity rate of the exposure light $L_1$ in a first case, while is negatively correlated with the light intensity rate of the exposure light $L_1$ in a second case. In the first case, an amount of change of the first reflectance to an amount of change of the light intensity rate of the exposure light $L_1$ is less than 1. In the second case, an amount of change of the first reflectance to an amount of change of the light intensity rate of the exposure light $L_1$ is more than 1.

9 Claims, 15 Drawing Sheets

ELECTROPHOTOGRAPHIC PHOTOSENSITIVE BODY AND IMAGE FORMING APPARATUS PROVIDED WITH THE SAME

CROSS-REFERENCE TO THE RELATED APPLICATIONS

This application is a national stage of international application No. PCT/JP2008/051200 filed on Jan. 28, 2008, which also claims the benefit of priority under 35 USC 119 to Japanese Patent Application No. 2007-020561 filed on Jan. 31, 2007, the entire contents of which are incorporated herein by reference.

TECHNICAL FIELD

The present invention relates to an electrophotographic photosensitive body having different reflectances according to a wavelength of irradiated light, and an image forming apparatus provided with the same.

BACKGROUND ART

An image formation in an image forming apparatus such as an electrophotographic copier or a printer is carried out as described below. Firstly, an area on the surface of an electrophotographic photosensitive body where a latent image is to be formed is uniformly charged with a charger. Next, the latent-image forming region is irradiated with an exposure light to remove charges on the electrophotographic photosensitive body, which is charged with the charger, according to a desired image pattern, whereby an electrostatic latent image is formed. Then, the electrostatic latent image is developed with toner to form a toner image, and then, the toner image is transferred and fixed onto a recording sheet. Next, the toner remaining on the surface of the electrophotographic photosensitive body is removed. Subsequently, the electrophotographic photosensitive body is irradiated with an eliminating light to eliminate the charges thereon. When the above-mentioned processes are repeated, an image is formed on a recording sheet.

In the image forming apparatus described above, an irradiation area of a laser beam used as the exposure light is increased as the angle of incidence of the beam on the electrophotographic photosensitive body is increased. Therefore, in the image formation described above, the light intensity changes according to the incidence angle of the laser beam. The conductivity of a photosensitive layer in the electrophotographic photosensitive body becomes high as the intensity of the light incident on the photosensitive layer is increased. Therefore, when the laser beam is scanned on the electrophotographic photosensitive body that is uniformly charged, the static elimination amount varies in the scanning direction of the laser beam, and further, the charging amount differs in the axial direction of the electrophotographic photosensitive body. When the charging amount differs as described above, the amount of toner, which is deposited with electrostatic force between the charged charges and the toner, varies, which appears as a difference (unevenness) in a color density of an image formed onto a recording sheet.

From the above, in the image forming apparatus described above, non-uniform image density might be produced in the scanning direction of the laser beam.

In view of this, an image forming apparatus has been developed in which a substantial light quantity is changed by the control of on/off time of the laser beam so as to reduce non-uniform image density. The apparatus described above is disclosed, for example, in Patent Document 1. In the image forming apparatus disclosed in Patent Document 1, in order to reduce a variation between a region where density becomes relatively low (hereinafter referred to as a "high static eliminating region") and a region where density becomes relatively high (hereinafter referred to as a "low static eliminating region"), an area of a static eliminating region in the high static eliminating region is made greater than an area of a static eliminating region in the low static eliminating region, wherein non-uniform image density is reduced by employing a human's visual characteristic.

Patent Document 1: Japanese Unexamined Patent Publication No. 05-011209

DISCLOSURE OF THE INVENTION

Problem to be Solved by the Invention

However, in the image forming apparatus disclosed in Patent Document 1, since the area of the static eliminating region in the high static eliminating region is increased, the size of each pixel constituting an image is increased with the increase of the area, which entails a problem that the definition of an image cannot be enhanced.

The present invention is accomplished in view of the foregoing circumstance, and aims to provide an electrophotographic photosensitive body that reduces non-uniform image density and that can enhance a definition of an image, and an image forming apparatus provided with the same.

Means for Solving the Problems

According to one aspect of the present invention, an electrophotographic photosensitive body includes a substrate and a photosensitive layer formed on the substrate. In the electrophotographic photosensitive body, when a reflectance of an exposure light for forming an electrostatic latent image is defined as a first reflectance, and a reflectance of an eliminating light for eliminating charges constituting the electrostatic latent image is defined as a second reflectance, the first reflectance is positively correlated with a light intensity rate of the exposure light, and the second reflectance is positively correlated with the light intensity rate in a first case, while is negatively correlated with the light intensity rate in a second case. The first case is such that a ratio of an amount of change of the first reflectance to an amount of change of the light intensity rate is less than 1. The second case is such that a ratio of an amount of change of the first reflectance to an amount of change of the light intensity rate is more than 1. The light intensity rate at a portion means the value obtained by dividing the light intensity at the portion of the electrophotographic photosensitive body by the maximum light intensity in the entire irradiated region of the electrophotographic photosensitive body.

According to another aspect of the present invention, an image forming apparatus includes the electrophotographic photosensitive body described above, charger for charging the electrophotographic photosensitive body, exposure means for emitting the exposure light, and eliminating means for emitting the eliminating light.

EFFECT OF THE INVENTION

The electrophotographic photosensitive body and the image forming apparatus according to the present invention can reduce non-uniform image density, and can enhance definition of an image.

BEST MODE FOR CARRYING OUT THE INVENTION

As shown in FIG. 1, an image forming apparatus 1 according to a first embodiment of the present invention includes an electrophotographic photosensitive body 2, a charger 3, an exposure unit 4, a developing unit 5, a transfer unit 6, a fixing unit 7, a cleaning unit 8, and a static eliminating unit 9.

The electrophotographic photosensitive body 2 has formed thereon an electrostatic latent image according to an image signal. It is configured to be rotatable in the direction indicated by an arrow A in FIG. 1. As shown in FIGS. 2A and 2B, the electrophotographic photosensitive body 2 includes a substrate 20 and a photosensitive layer 21.

The substrate 20 serves as a bone structure of the electrophotographic photosensitive body 2. The substrate 20 is formed to have at least conductivity on its surface. Specifically, the entire substrate 20 may be made of a conductive material, or the substrate 20 may be formed such that a conductive film containing a conductive material is formed on a surface of an insulator made of an insulating material. Examples of the conductive material constituting the substrate 20 include a metal material such as aluminum (Al), stainless steel (SUS), zinc (Zn), copper (Cu), iron (Fe), titanium (Ti), nickel (Ni), chromium (Cr), tantalum (Ta), tin (Sn), gold (Au), and silver (Ag), an alloy material containing the metal materials described above, and a transparent conductive material such as ITO and $SnO_2$. Particularly, an Al alloy material is preferable from the viewpoint of adhesiveness to the photosensitive layer 21 formed from a non-single-crystal material (a-Si material) having a silicon atom as a matrix. Examples of the insulating material constituting the substrate 20 include a resin, glass, and ceramic. Examples of the material for the conductive film constituting the substrate 20 include the metals same as those of the conductive material constituting the substrate 20, and transparent conductive material such as ITO (Indium Tin Oxide), and $SnO_2$.

The shape of the substrate 20 is cylindrical in the present embodiment. However, the shape of the substrate 20 is not limited thereto. The substrate 20 may have a shape of a rectangular column or flat plate shape. The length W of the substrate 20 in the axial direction in the present embodiment is set slightly longer than the maximum length of a recording medium P in the direction orthogonal to the feeding direction (the direction indicated by an arrow B). Specifically, the length W of the substrate 20 in the axial direction is set longer than the recording medium P by, for example, 0.5 cm or more and 5 cm or less from both ends of the recording medium P.

The substrate 20 may have inlaid parts 20*a* and 20*b* and a mark 20*c* as in the present embodiment.

The photosensitive layer 21 includes a latent-image forming region 21*a* and a non-latent-image forming region 21*b*. The latent-image forming region 21*a* is a region where an electrostatic latent image corresponding to the maximum length of the recording medium P, which is to be used, is formed. The non-latent-image forming region 21*b* is a region (the region outside the latent-image forming region 21*a* in the axial direction) where an electrostatic latent image is not formed even when an electrostatic latent image corresponding to the maximum length of the recording medium P, which is to be used, is formed.

The photosensitive layer 21 includes a photoconductor layer 211 and a surface layer 212, and is formed on the outer peripheral surface 20*e* of the substrate 20. The photosensitive layer 21 may also have either one of a charge injection inhibiting layer and a long wavelength absorbing layer between the photoconductor layer 211 and the substrate 20. The photosensitive layer 21 may also have a transition layer, which transits stepwisely (or substantially gradually) from the composition in one layer toward the composition of the other layer, between the layers constituting the photosensitive layer 21.

The photoconductor layer 211 is for generating free electrons or carriers such as holes due to the excitation of electrons, which is caused by the irradiation of exposure light $L_1$ from the exposure unit 4. Examples of the materials constituting the photoconductor layer 211 include an a-Si material, a-Se material such as a-Se, Se—Te, and $As_2Se_3$, a material constituted by a compound containing a 12 to 16-group element of the periodic table such as ZnO, CdS, and CdSe, a material obtained by dispersing particles made of these materials into a resin, and a photosensitive material such as OPC. Particularly, the a-Si material and the a-Si based alloy material obtained by adding C, N, and O etc. into the a-Si material are preferable from the viewpoint of electrophotographic performance and the consistency with the surface layer 212 when the surface layer 212 is made of a-SiC:H. Examples of the a-Si material include a-Si, a-SiC, a-SiN, a-SiO, a-SiGe, a-SiCN, a-SiCO, and a-SiCNO.

The surface layer 212 is for enhancing durability of the electrophotographic photosensitive body 2, and it is laminated on the photoconductor layer 211. The thickness of the surface layer 212 in the present embodiment is set so as to stepwisely (or substantially gradually) reduce from one end (from the inlaid part 20*a*) of the latent-image forming region 21*a* toward the other end (toward the inlaid part 20*b*) in the axial direction of the electrophotographic photosensitive body 2. Examples of the material constituting the surface layer 212 include a-Si material. It is particularly preferable to employ hydrogenated amorphous silicon carbide from the viewpoint of hardness and light transparency.

One example of a method of producing the electrophotographic photosensitive body 2 will be described here.

Firstly, the substrate 20 having the inlaid parts 20*a* and 20*b* is prepared.

Subsequently, the substrate 20 is washed in order to remove dirt on the outer peripheral surface 20*a* of the substrate 20 (washing process). Specifically, the substrate 20 is immersed into wash solution, and then, ultrasonic wave is applied to the wash solution to perform the washing process. Examples of the wash solution include an aqueous cleaning material, petroleum cleaning material, alcohol-based cleaning material, and chlorine cleaning material.

Next, the photoconductor layer 211 is formed on the outer peripheral surface 20*a* of the washed substrate 20 (first film-forming process). Specifically, the photoconductor layer 211 is formed on the outer peripheral surface 20*a* of the substrate 20 by means of a glow discharge decomposition apparatus 22 which is well known shown in FIGS. 3 and 4. The illustrated glow discharge decomposition apparatus 22 forms an a-Si film on the substrate 20 by applying glow discharge plasma with the substrate 20 being supported by a substrate supporting member 221 arranged at the center of a cylindrical vacuum chamber 220. In the glow discharge decomposition apparatus 22, the substrate supporting member 221 is grounded, and the vacuum chamber 220 is connected to a high-frequency power supply 222, so that high-frequency power can be applied between the vacuum chamber 220 and the substrate supporting member 221 (substrate 20). The substrate supporting member 221 can be rotated by a rotating mechanism 223, and it is heated by a heater 224 arranged therein. The glow discharge decomposition apparatus 22 is provided with a plurality of (eight in the figure) gas inlet pipes 225 that are arranged so as to enclose the substrate supporting member 221 (substrate 20). Each of the gas inlet pipes 225 has a plurality of gas inlets 225*a* arranged in the axial direction. The plurality of gas inlets 225*a* are arranged so as to oppose to the substrate 20, whereby a source gas introduced through the plurality of gas inlets 225*a* is ejected toward the substrate 20. The plurality of gas inlets 225*a* are arranged in such a manner that the arrangement density thereof is substantially equal from the end portion, which is at the side of the inlaid part 20*a*, toward the end portion, which is the side of the inlaid part 20*b*, of the substrate 20. When the photoconductor layer 211 made of a-Si material is formed on the substrate 20 by using the glow discharge decomposition apparatus 22, a source gas having a predetermined flow rate and gas ratio is introduced from the gas inlet pipes 225 toward the substrate 20 through the gas inlets 225*a*. In this case, the substrate 20 is rotated by the rotating mechanism 223 together with the substrate supporting member 221. High-frequency power is applied between the vacuum chamber 220 and the substrate supporting member (substrate 20) by the high-frequency power supply 222 so as to decompose the source gas between them by the glow discharge, whereby the photoconductor layer 211 is formed on the substrate 20 that is set to a desired temperature.

Then, the surface layer 212 is formed on the photoconductor layer 211 (second film-forming process). Specifically, the surface layer 212 is formed on the photoconductor layer 211 by the glow discharge decomposition apparatus 22 in which the gas inlet pipes 225 are replaced with gas inlet pipes 226. As shown in FIG. 5, each of the gas inlet pipes 226 has a plurality of gas inlets 226*a* arranged in the axial direction. The plurality of gas inlets 226*a* are arranged such that its arrangement density is stepwisely (or substantially gradually) decreased from the end portion, which is at the side of the inlaid part 20*a*, toward the end portion, which is at the side of the inlaid part 20*b*, of the substrate 20.

As described above, the electrophotographic photosensitive body 2 shown in FIGS. 2A and 2B is formed.

The charger 3 is for charging the electrophotographic photosensitive body 2 to a positive polarity or negative polarity. The charged polarity of the electrophotographic photosensitive body 2 is set in accordance with, for example, the photoconductor layer constituting the electrophotographic photosensitive body 2. The charged potential of the electrophotographic photosensitive body 2 is generally set to be 200 V or more and 1000 V or less.

The exposure unit 4 is for forming an electrostatic latent image in accordance with an image signal onto the electrophotographic photosensitive body 2. Specifically, the exposure unit 4 irradiates the electrophotographic photosensitive body 2 that is charged with the charger 3 with exposure light $L_1$ corresponding to the image signal so as to attenuate the potential of the irradiated portion, with the result that the electrostatic latent image as a potential contrast is formed.

The exposure unit 4 in the present embodiment has alight source 40 and a scanning mechanism 41 as shown in FIG. 6. Although the exposure unit 4 in the present embodiment has the scanning mechanism 41, the exposure unit 4 is not limited thereto. For example, the exposure unit 4 may not have the scanning mechanism 41, but have a plurality of light sources 40 arranged along the axial direction of the electrophotographic photosensitive body 2.

The light source 40 is for emitting the exposure light $L_1$ for forming the electrostatic latent image onto the electrophotographic photosensitive body 2. The wavelength of the exposure light $L_1$ is set to, for example, 650 nm or more and 780 nm or less. Examples of the light source 40 include a laser oscillator, light-emitting diode (LED), and electroluminescence (EL). Particularly, a laser oscillator that emits light (laser beam La) having high linearity compared to the LED and the like is preferable from the viewpoint of forming a detailed electrostatic latent image. The light source 40 is not limited to the one emitting only light having a single wavelength. The one emitting light of a plurality of wavelengths may be employed. In the present embodiment, a laser oscillator is used as the light source 40.

The scanning mechanism 41 is for scanning the irradiated laser beam La (corresponding to the exposure light $L_1$) to the electrophotographic photosensitive body 2. The scanning mechanism 41 includes a polarizer and a drive unit not shown. The polarizer is for polarizing the laser beam La, and it is configured to include a polygon mirror, for example. The drive unit is for driving the light source 40 and the above-mentioned polarizer, and includes a rotating stage or a single-axis drive stage. The present embodiment is described below such that the scanning mechanism 41 includes a polygon mirror and a rotating stage. The scanning mechanism 41 in the present embodiment scans the laser beam La onto the electrophotographic photosensitive body 2 by rotating the polygon mirror, which is arranged so as to oppose to the end portion of the electrophotographic photosensitive body 2 at the inlaid part 20*a*, with the rotating stage. Therefore, when the laser beam La is scanned by using the polygon mirror, the incident angle of the laser beam La to the electrophotographic photosensitive body 2 becomes the minimum at the end that is at the side of the inlaid part 20*a* of the electrophotographic photosensitive body 2, but the maximum at the end that is at the side of the inlaid part 20*b* of the electrophotographic photosensitive body 2. Specifically, in the exposure unit 4 in the present embodiment, the light intensity of the laser beam La becomes the maximum at the end of the electrophotographic photosensitive body 2 at the inlaid part 20*a*, and stepwisely (or substantially gradually) reduces toward the end of the electrophotographic photosensitive body 2 at the inlaid part 20*b*. When the scanning mechanism 41 is arranged in the vicinity of one end of the electrophotographic photosensitive body 2 in the axial direction as in the present embodiment, the ratio of occupancy of the scanning mechanism 41 in the space above the latent-image forming region 21*a* of the electrophotographic photosensitive body 2 can be reduced, which is preferable in order to downsize the image forming apparatus 1.

The developing unit 5 is for developing the electrostatic latent image formed on the electrophotographic photosensitive body 2 with a developing material so as to form a toner image. The developing unit 5 includes a case 50 and a sleeve 51.

The case 50 is for holding the developing material T. The developing material T is for developing the electrostatic latent image formed on the electrophotographic photosensitive body 2. The developing material T is charged with friction in the developing unit 5. The developing material T is deposited onto the electrophotographic photosensitive body 2 in accordance with the electrostatic latent image, thereby forming a toner image. The charged polarity of the developing material T is reverse to the charged polarity of the electrophotographic photosensitive body 2 when the image formation is done with a normal development, while it is the same as the charged polarity of the electrophotographic photosensitive body 2 when the image formation is done with a reverse development. Examples of the developing material T include a two-component developing material containing magnetic carrier and insulating toner, and one-component developing material containing magnetic toner.

The sleeve 51 is for carrying the developing material T to the developing region between the electrophotographic photosensitive body 2 and the developing unit 5. Specifically, the charged toner is carried in the form of a magnetic brush that is adjusted to have a fixed length.

The transfer unit 6 is for transferring the toner image onto the recording medium P such as a recording sheet fed to the transfer region between the electrophotographic photosensitive body 2 and the transfer unit 6. The transfer unit 6 includes a transfer charger 60 and a separation charger 61.

The transfer charger 60 is for charging the recording medium P with a polarity reverse to the polarity of the toner image. With the transfer charger 60 thus configured, the toner image is transferred onto the recording medium P with electrostatic attraction force between the charged charges of the recording medium P and the charged charges of the toner image.

The separation charger 61 is for AC-charging the recording medium P simultaneous with the transfer of the toner image by the transfer charger 60. With the separation charger 61 thus configured, the recording medium P can quickly be separated from the electrophotographic photosensitive body 2.

Instead of the transfer charger 60 and the separation charger 61 described above, a transfer roller (separation distance: generally 0.5 mm or less) that is arranged so as to be apart from the electrophotographic photosensitive body 2 and rotates with the rotation of the electrophotographic photosensitive body 2 may be employed as the transfer unit 6. The transfer roller is configured to apply a transfer voltage that attracts the toner image formed onto the electrophotographic photosensitive body 2 onto the recording medium P by, for example, a DC power supply. When the transfer roller having the above-mentioned configuration is used, a transfer material separating unit such as the separation charger 61 can be eliminated.

The fixing unit 7 is for fixing the toner image transferred onto the recording medium P onto the recording medium P. The fixing unit 70 includes a pair of fixing rollers 70 and 71. The pair of fixing rollers 70 and 71 exerts, for example, heat and pressure to the one passing through the rollers 70 and 71. With the fixing unit 7 thus configured, the toner image can be fixed onto the recording medium P with heat and pressure by allowing the recording medium P to pass between the pair of rollers 70 and 71.

The cleaning unit 8 is for removing the developing material T left on the electrophotographic photosensitive body 2. The cleaning unit 8 includes a blade 80 and a case 81. The blade 80 is for scraping off the developing material T remaining onto the electrophotographic photosensitive body 2. The case 81 is for holding the developing material T scraped off by the blade 80. The cleaning unit 8 has a recycle mechanism in the case 50 of the developing unit 5 in order to reuse the developing material T collected into the case 81.

The static eliminating unit 9 is for removing a surface charge (charges constituting the electrostatic latent image) on the electrophotographic photosensitive body 2. Specifically, the static eliminating unit 9 irradiates the electrophotographic photosensitive body 2 with a static eliminating light $L_2$ to attenuate the potential of the irradiated portion, thereby removing charges.

The static eliminating unit 9 in the present embodiment includes unillustrated light source. The light source emits the static eliminating light $L_2$ for eliminating the surface charges of the electrophotographic photosensitive body 2. The wavelength of the static eliminating light $L_2$ is set to be, for example, 650 nm or more and 780 nm or less. Examples of the light source include a laser oscillator, LED and EL, among which the LED is preferable that emits light having high diffusing performance compared to the laser oscillator from the viewpoint of obtaining a uniform static elimination effect over a wide range. In the present embodiment, the light source of the static eliminating unit 9 is provided with a plurality of LEDs arranged along the axial direction of the electrophotographic photosensitive body 2.

Light interference on the photosensitive layer 21 of the electrophotographic photosensitive body 2 will be described with reference to FIGS. 7 to 10. FIG. 7 is a schematic view illustrating the state of light interference on the photosensitive layer 21 of the electrophotographic photosensitive body 2. FIG. 8 shows the result obtained by measuring the reflectance of the electrophotographic photosensitive body 2 at the central part (the thickness of the surface layer: 976 nm) in the axial direction with an optical thickness gauge (MC-850A, manufactured by Otsuka Electronics Co., Ltd.). FIG. 9 shows the result of the measurement in which an electrophotographic photosensitive body 2 having the surface layer whose thickness is changed within the range of 500 nm or more and 1000 nm or less is prepared, and the reflectance within this range is measured with an optical thickness gauge (MC-850A, manufactured by Otsuka Electronics Co., Ltd.). FIG. 10 shows the result in which the ratio of the reflectance of the light having the wavelength of 650 nm to the reflectance of the light having the wavelength of 700 nm is calculated from the result of the measurement shown in FIG. 9.

As shown in FIG. 7, among the irradiated lights to the electrophotographic photosensitive body 2, the light $L_{11}$ reflected on the outer surface 212*a* of the surface layer 212 of the photosensitive layer 21 and the light $L_{12}$ passing through the outer surface 212*a* and reflected by the inside (e.g., the interface 211*a* between the photoconductor layer 211 and the surface layer 212) of the photosensitive layer 21 interfere with each other. Specifically, the light $L_{11}$ and the light $L_{12}$ reinforce or weaken with each other depending upon the phase difference between the phase of the light $L_{11}$ and the phase of the light $L_{12}$. The phase difference varies according to the distance (the difference in the optical path of the light $L_{11}$ and the light $L_{12}$) of the irradiated light to the electrophotographic photosensitive body 2, which distance is from the point when it passes through the outer surface 212*a* to be reflected at the inside of the photosensitive layer 21 to the point when it returns to the outer surface 212*a*. Therefore, the light interference condition is different for every wavelength of irradiated light to the electrophotographic photosensitive body 2 as shown in FIG. 8, and different for every thickness of the surface layer 212 of the electrophotographic photosensitive body 2 as shown in FIG. 9.

Based on the above-mentioned fact, the reflectance (hereinafter referred to as a "first reflectance") to the wavelength of the exposure light $L_1$ and the reflectance (hereinafter referred to as a "second reflectance") to the wavelength of the static eliminating light $L_2$ are set to the condition (hereinafter referred to as a "reflectance condition") described below in the electrophotographic photosensitive body 2. The first reflectance is positively correlated with the light intensity rate of the exposure light $L_1$. The second reflectance is positively correlated with the ratio of the intensity when the amount of change of the first reflectance to the amount of change of the light intensity rate of the exposure light $L_1$ is less than 1 (in the first case), while it is negatively correlated with the ratio of the intensity when the amount of change of the first reflectance to the amount of change of the light intensity rate of the exposure light $L_1$ is more than 1 (in the second case). The light intensity rate means the value obtained by dividing the light intensity at a predetermined portion of the electrophotographic photosensitive body 2 by the maximum light intensity in the entire light-irradiated region of the electrophotographic photosensitive body 2.

In the electrophotographic photosensitive body 2 in the present embodiment, the first reflectance is positively correlated with the light intensity rate of the exposure light $L_1$, and the second reflectance is positively correlated with the light intensity rate in the first case while negatively correlated with the light intensity rate in the second case. Specifically, in the electrophotographic photosensitive body 2, there is a tendency that, the greater the light intensity rate of the exposure light $L_1$ irradiated to the electrophotographic photosensitive body 2 is, the greater the first reflectance becomes. In the electrophotographic photosensitive body 2, there is a tendency that, the greater the light intensity rate of the exposure light $L_1$ radiated to the electrophotographic photosensitive body 2 is, the greater the second reflectance becomes in the first case, and the greater the light intensity rate of the exposure light $L_1$ radiated to the electrophotographic photosensitive body 2 is, the smaller the second reflectance becomes in the second case. Therefore, in the electrophotographic photosensitive body 2, the variation in the static eliminating amount (consequently, the variation in the charged amount) caused by the difference in the intensity of the exposure light $L_1$ can be reduced. Accordingly, in the electrophotographic photosensitive body 2, non-uniform image density can be prevented that is produced due to the variation in the deposited toner amount caused by the variation in the charged amount. Further, in the electrophotographic photosensitive body 2, even if the area of the static eliminating region in the high static eliminating region is not increased more than the area of the static eliminating region in the low static eliminating region, the non-uniform image density can be reduced, whereby the definition of the image can be enhanced by that much.

In the electrophotographic photosensitive body 2, the first reflectance and the second reflectance are adjusted in accordance with the thickness of the surface layer 212. Specifically, the thickness of the surface layer 212 is set so as to stepwisely (or substantially gradually) decrease from one end of the latent-image forming region 21*a* (from the inlaid part 20*a*) toward the other end (toward the inlaid part 20*b*) in the axial direction of the electrophotographic photosensitive body 2 within the range satisfying the reflectance condition described above. By virtue of this structure, even if the electrophotographic photosensitive body 2 is mounted to the image forming apparatus 1 that is configured such that the light intensity rate of the exposure light $L_1$ stepwisely (or substantially gradually) decreases from one end toward the other end of the electrophotographic photosensitive body 2, such as in the case in which the light source 40 is arranged at one end of the electrophotographic photosensitive body 2, the non-uniform image density can be reduced to enhance definition of an image by a relatively simple technique such as the adjustment of the thickness of the surface layer 212.

Since the image forming apparatus 1 according to the present embodiment includes the electrophotographic photosensitive body 2, the effect same as that obtained by the electrophotographic photosensitive body 2 can be provided. Specifically, in the image forming apparatus 1, definition of an image can be enhanced, while decreasing non-uniform image density.

As shown in FIG. 11, an image forming apparatus 1A according to a second embodiment of the present invention is different from the image forming apparatus 1 in that an electrophotographic photosensitive body 2A is employed instead of the electrophotographic photosensitive body 2 and an exposure unit 4A is employed instead of the exposure unit 4. The other structures of the image forming apparatus 1A are the same as those of the image forming apparatus 1.

The electrophotographic photosensitive body 2A is the same as the electrophotographic photosensitive body 2 in that the first reflectance (the reflectance to the wavelength of the exposure light $L_1$) and the reflectance (second reflectance) to the wavelength of the static eliminating light $L_2$ are set to the reflectance condition described above. On the other hand, the electrophotographic photosensitive body 2A is different from the electrophotographic photosensitive body 2 in that a surface layer 212A is used instead of the surface layer 212 as shown in FIG. 12. The thickness of the surface layer 212A stepwisely (or substantially gradually) reduces from both end portions of the latent-image forming region 21*a* toward the central part in the axial direction of the electrophotographic photosensitive body 2A. The other structures of the electrophotographic photosensitive body 2A are the same as those of the electrophotographic photosensitive body 2.

One example of a manufacturing method of the electrophotographic photosensitive body 2A will be described here. The manufacturing method of the electrophotographic photosensitive body 2A is the same as the electrophotographic photosensitive body 2 except for the second film-forming process. In the second film-forming process in the manufacturing method of the electrophotographic photosensitive body 2A, the surface layer 212*a* is formed on the photoconductor layer 211 by a glow discharge decomposition apparatus 22 provided with gas inlet pipes 226A instead of the gas inlet pipes 226. Each of the gas inlet pipes 226A has a plurality of gas inlets 226Aa arranged in the axial direction as shown in FIG. 13. The arrangement density of the plurality of gas inlets 226Aa is stepwisely (or substantially gradually) reduced from both end portions of the substrate 20 toward the central part.

As shown in FIG. 14, the exposure unit 4A is the same as the exposure unit 4 except for the position of the polygon mirror constituting the scanning mechanism 41. The polygon mirror constituting the scanning mechanism 41 is located at the position opposite to the central part of the electrophotographic photosensitive body 2A in the axial direction. Therefore, when the laser beam La is scanned by using the polygon mirror, the angle of incidence of the laser beam La to the electrophotographic photosensitive body 2A becomes the maximum at both end portions of the electrophotographic photosensitive body 2A in the axial direction, while becomes the minimum at the central part of the electrophotographic photosensitive body 2A in the axial direction. Specifically, by the exposure unit 4A in the present embodiment, the intensity of the laser beam La becomes the maximum at the central part of the electrophotographic photosensitive body 2A in the axial direction, while stepwisely (or substantially gradually) reduces toward both end portions of the electrophotographic photosensitive body 2A in the axial direction.

Since the electrophotographic photosensitive body 2A has the above-mentioned structure, the effect same as that obtained by the electrophotographic photosensitive body 2 can be provided. Specifically, in the electrophotographic photosensitive body 2A, the definition of an image can be enhanced, while reducing non-uniform image density.

In the electrophotographic photosensitive body 2A, the thickness of the surface layer 212A is set so as to stepwisely (or substantially gradually) decrease from both end portions of the latent-image forming region 21*a* toward the central part in the axial direction of the electrophotographic photosensitive body 2A. Therefore, when the electrophotographic photosensitive body 2A is mounted to the image forming apparatus 1A provided with the exposure unit 4A, the angle of incidence of the exposure light $L_1$ (laser beam La) can be reduced even at both end portions of the electrophotographic photosensitive body 2A in the axial direction. Accordingly, the electrophotographic photosensitive body 2A is preferable for reducing the variation in the intensity of the exposure light $L_1$ in the axial direction thereof and enhancing the utilization ratio of the exposure light $L_1$.

As shown in FIG. 15, an image forming apparatus 1B according to a third embodiment of the present invention is different from the image forming apparatus 1 in that an electrophotographic photosensitive body 2B is employed instead of the electrophotographic photosensitive body 2, and an exposure unit 4B is employed instead of the exposure unit 4. The other structures of the image forming apparatus 1B are the same as those of the image forming apparatus 1.

The electrophotographic photosensitive body 2B is the same as the electrophotographic photosensitive body 2 in that the first reflectance (the reflectance to the wavelength of the exposure light $L_1$) and the reflectance (second reflectance) to the wavelength of the static eliminating light $L_2$ are set to the reflectance condition described above. On the other hand, the electrophotographic photosensitive body 2B is different from the electrophotographic photosensitive body 2 in that a surface layer 212B is used instead of the surface layer 212 as shown in FIG. 16. The thickness of the surface layer 212B stepwisely (or substantially gradually) increases from both end portions of the latent-image forming region 21*a* toward the central part in the axial direction of the electrophotographic photosensitive body 2B. The other structures of the electrophotographic photosensitive body 2B are the same as those of the electrophotographic photosensitive body 2.

One example of a manufacturing method of the electrophotographic photosensitive body 2B will be described here. The manufacturing method of the electrophotographic photosensitive body 2B is the same as the electrophotographic photosensitive body 2 except for the second film-forming process. In the second film-forming process in the manufacturing method of the electrophotographic photosensitive body 2B, the surface layer 212B is formed on the photoconductor layer 211 by a glow discharge decomposition apparatus 22 provided with gas inlet pipes 226B instead of the gas inlet pipes 226. Each of the gas inlet pipes 226B has a plurality of gas inlets 226Ba arranged in the axial direction as shown in FIG. 17. The arrangement density of the plurality of gas inlets 226Ba is stepwisely (or substantially gradually) increased from both end portions of the substrate 20 toward the central part.

As shown in FIG. 18, the exposure unit 4B is the same as the exposure unit 4 except that one pair of the light source 40 and the scanning mechanism 41 is further added. The polygon mirror constituting the added scanning mechanism 41 is located at the position opposite to the end portion of the electrophotographic photosensitive body 2A at the inlaid part 20*b*. Therefore, when the laser beam La is scanned by using the polygon mirror of the exposure unit 4B, the angle of incidence of the laser beam La to the electrophotographic photosensitive body 2B becomes the minimum at both end portions of the electrophotographic photosensitive body 2B in the axial direction, while becomes the maximum at the central part of the electrophotographic photosensitive body 2B in the axial direction. Specifically, by the exposure unit 4B in the present embodiment, the intensity of the laser beam La becomes the minimum at the central part of the electrophotographic photosensitive body 2B in the axial direction, while stepwisely (or substantially gradually) increases toward both end portions of the electrophotographic photosensitive body 2B in the axial direction.

Since the electrophotographic photosensitive body 2B has the above-mentioned structure, the effect same as that obtained by the electrophotographic photosensitive body 2 can be provided. Specifically, in the electrophotographic photosensitive body 2B, the definition of an image can be enhanced, while reducing non-uniform image density.

In the electrophotographic photosensitive body 2B, the thickness of the surface layer 212B is set so as to stepwisely (or substantially gradually) increases from both end portions of the latent-image forming region 21*a* toward the central part in the axial direction of the electrophotographic photosensitive body 2B. Therefore, when the electrophotographic photosensitive body 2B is mounted to the image forming apparatus 1A provided with the exposure unit 4B, the angle of incidence of the exposure light $L_1$ (laser beam La) can be reduced even at the central part of the electrophotographic photosensitive body 2B in the axial direction. Accordingly, the electrophotographic photosensitive body 2B is preferable for reducing the variation in the intensity of the exposure light $L_1$ in the axial direction thereof and enhancing the utilization ratio of the exposure light $L_1$.

The specific embodiments of the present invention have been described above. However, the present invention is not limited thereto. Various modifications are possible without departing from the scope of the present invention. The example thereof will be described below.

The image forming apparatuses 1, 1A, and 1B may be configured to form a color image. A color in a color image is expressed by the amount of deposited toner generally composed of three primary colors (e.g., cyan, magenta, yellow). Therefore, non-uniform density of each of three primary colors is necessarily reduced. By virtue of the electrophotographic photosensitive bodies 2, 2A and 2B, the non-uniform density of three primary colors can sufficiently be reduced. Accordingly, the image forming apparatuses 1, 1A, and 1B are preferable for forming a color image.

In the electrophotographic photosensitive bodies 2, 2A, and 2B, the first reflectance and the second reflectance are adjusted so as to satisfy the aforesaid reflectance condition by adjusting the thicknesses of the surface layers 212, 212A, and 212B. However, the present invention is not limited thereto. For example, the materials (or compositions) of the surface layers 212, 212A, and 212B may be adjusted.

The thickness of the surface layer 212 of the electrophotographic photosensitive body 2 is not particularly limited so long as it satisfies the above-mentioned reflectance condition. For example, the surface layer 212 may be formed in such a manner that its thickness stepwisely (or substantially gradually) increases from the end portion at the inlaid part 20*a* toward the end portion at the inlaid part 20*b* of the electrophotographic photosensitive body 2 in the axial direction.

The thickness of the surface layer 212A of the electrophotographic photosensitive body 2A is not particularly limited so long as it satisfies the above-mentioned reflectance condition. For example, the surface layer 212A may be formed in such a manner that its thickness stepwisely (or substantially gradually) increases from both end portions toward the central part of the electrophotographic photosensitive body 2A in the axial direction. Alternatively, the surface layer 212A may be formed in such a manner that its thickness stepwisely (or substantially gradually) increases or decreases from one end portion toward the other end portion of the electrophotographic photosensitive body 2A in the axial direction.

The thickness of the surface layer 212B of the electrophotographic photosensitive body 2B is not particularly limited so long as it satisfies the above-mentioned reflectance condition. For example, the surface layer 212B may be formed in such a manner that its thickness stepwisely (or substantially gradually) decreases from both end portions toward the central part of the electrophotographic photosensitive body 2B in the axial direction. Alternatively, the surface layer 212B may be formed in such a manner that its thickness stepwisely (or substantially gradually) increases or decreases from one end portion toward the other end portion of the electrophotographic photosensitive body 2B in the axial direction.

The electrophotographic photosensitive body according to the present invention is not limited to the electrophotographic photosensitive bodies 2, 2A, and 2B. The other configuration may be employed so long as it satisfies the aforesaid reflectance condition. For example, when an exposure unit 4C is used instead of the exposure unit 4B in the image forming apparatus 1B as shown in FIG. 19, the light intensity rate of the laser beam La radiated to an electrophotographic photosensitive body 2C stepwisely (or substantially gradually) decreases from the position of the electrophotographic photosensitive body 2C opposite to the polygon mirror toward the central part thereof in the axial direction, and stepwisely (or substantially gradually) decreases from the position of the electrophotographic photosensitive body 2C opposite to the polygon mirror toward both end portions thereof in the axial direction. In this case too, if the thicknesses of the surface layers 212, 212A, and 212B are set within a suitable range so as to satisfy the aforesaid reflectance condition based upon the embodiments of the electrophotographic photosensitive bodies 2, 2A, and 2B, a desired effect can be provided. The exposure unit 4C is different from the exposure unit 4B in that polygon mirrors constituting two scanning mechanisms 41 are arranged so as to be opposite to each other at the position close to the central part from both end portions of the electrophotographic photosensitive body 2C in the axial direction.

When the static eliminating unit 9 includes a plurality of (two in the figure) light sources 90 as shown in FIG. 20, there may be the case in which the light intensity rate of the static eliminating light $L_2$ radiated to the electrophotographic photosensitive bodies 2, 2A, and 2B is different in the axial direction thereof. In this case too, if the thicknesses of the surface layers 212, 212A, and 212B are set within a suitable range so as to satisfy the aforesaid reflectance condition based upon the embodiments of the electrophotographic photosensitive bodies 2, 2A, and 2B, a desired effect can be provided.

It is preferable that the first reflectance of each of the electrophotographic photosensitive bodies 2, 2A, and 2B is set so as to be the maximum at the region where the light intensity rate of the exposure light $L_1$ becomes the maximum. Particularly, it is preferable that, at the region where the light intensity rate of the exposure light $L_1$ becomes the maximum, the second reflectance of each of the electrophotographic photosensitive bodies 2, 2A, and 2B becomes the maximum when the amount of change of the first reflectance to the amount of change of the light intensity rate of the exposure light $L_1$ is less than 1, and becomes the minimum when the amount of change of the first reflectance to the amount of change of the light intensity rate of the exposure light $L_1$ is more than 1. By virtue of this configuration, the variation in the static eliminating amount (consequently, the variation in the charged amount) caused by the difference in the intensity of the exposure light $L_1$ can suitably be reduced. Accordingly, non-uniform image density can suitably be prevented that is produced due to the variation in the deposited toner amount caused by the variation in the charged amount.

It is preferable that the ratio of the second reflectance to the first reflectance in each of the electrophotographic photosensitive bodies 2, 2A, and 2B is set so as to be negatively correlated with the light intensity rate of the exposure light $L_1$. In particular, it is preferable that the ratio of the second reflectance to the first reflectance in each of the electrophotographic photosensitive bodies 2, 2A, and 2B is set to become the minimum at the region where the light intensity rate of the exposure light $L_1$ becomes the maximum. By virtue of this configuration, the variation in the static eliminating amount (consequently, the variation in the charged amount) caused by the difference in the intensity of the exposure light $L_1$ can be reduced based upon the first reflectance more than the second reflectance. Accordingly, the variation in the charged amount upon the deposition of toner can further be reduced, whereby the occurrence of the non-uniform image density can more suitably be reduced.

When the difference between the maximum value and the minimum value of the optical thickness of the surface layers 212, 212A, and 212B in the latent-image forming region 21*a* of the electrophotographic photosensitive bodies 2, 2A, and 2B is set within the range of 0.25 or more times the wavelength of the exposure light $L_1$ and 0.25 or more times the wavelength of the static eliminating light $L_2$, at least one of the region where the first reflectance becomes the maximum and the region where the second reflectance becomes the minimum can be present between the region where the optical thickness of the surface layer 212, 212A, and 212B becomes the maximum and the region where it becomes the minimum. Accordingly, in the electrophotographic photosensitive bodies 2, 2A, and 2B thus configured, the first reflectance is adjusted so as to become the maximum in the region where the light intensity rate of the exposure light $L_1$ becomes the maximum, or the second reflectance is adjusted so as to become the minimum in the region where the light intensity rate of the static eliminating light $L_2$ becomes the minimum, whereby a desired effect can be obtained.

The thickness of each of the surface layers 212, 212A, and 212B of the electrophotographic photosensitive bodies 2, 2A, and 2B is adjusted by the arrangement density of the gas inlets 226*a*, 226Aa, and 226Ba of the gas inlet pipes 226, 226A, and 226B in the glow discharge decomposition apparatus 22, but the invention is not limited thereto. For example, instead of adjusting the arrangement density of the gas inlets 226*a*, 226Aa, and 226Ba, the thickness may be adjusted by the diameter of the opening of each of the gas inlets, or the thickness may be adjusted by the heating control of the heater 224. Further, the thickness may be adjusted by the feed amount of source gas or exhaust amount of gas in the vacuum chamber 220. Specifically, when the diameter of the opening of each of the gas inlets is increased, the thickness of the surface layer can be increased compared to the portion corresponding to the opening having a small diameter. When the temperature distribution is made in the axial direction of the substrate 20 by the heater 224, the thickness of the surface layer at the portion corresponding to the high-temperature region can be increased compared to the portion corresponding to a relatively low-temperature region. When the feed amount of the source gas is increased, the thickness of the surface layer near the gas inlet can be increased. When the exhaust amount in the vacuum chamber 220 is increased, the thickness of the surface layer near the exhaust port can be decreased. In the adjustment of the thickness of the surface layers 212, 212A, and 212B through the heating control by the heater 224, and the control of the feed amount of the source gas and the exhaust amount of the gas in the vacuum chamber 220, the operation of exchanging the gas inlet pipe 225 with the gas inlet pipes 226, 226A, and 226B can be made unnecessary, and further, the intrusion of impurities into the vacuum chamber 220 during the exchanging operation can be prevented.

The light source 40 may further have a filter for absorbing light having a predetermined wavelength as needed.

EXPLANATION OF REFERENCE SYMBOLS

Figure 1:
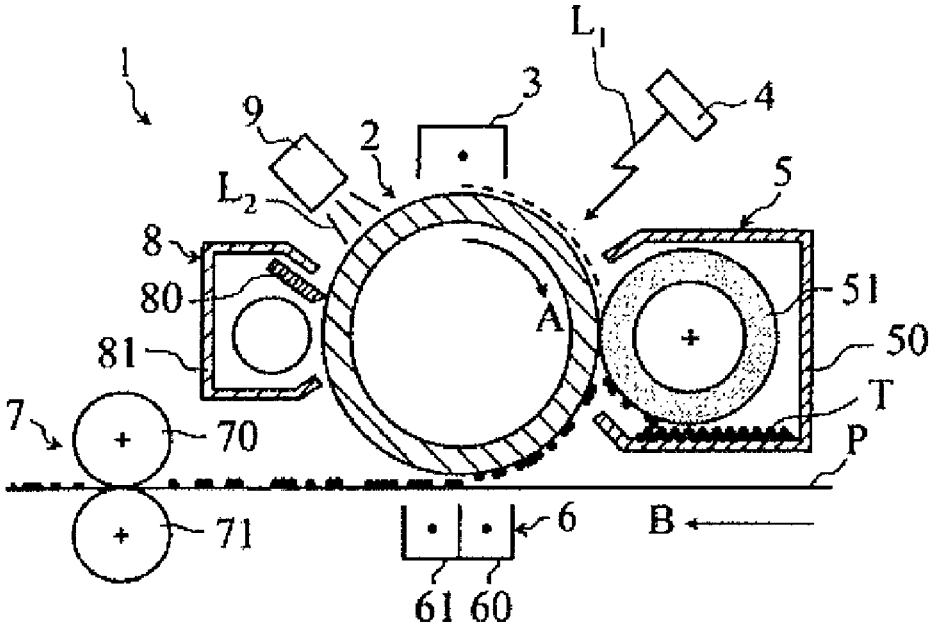
FIG. 1 is a view showing a schematic configuration of an image forming apparatus according to a first embodiment of the present invention.
Figure 2A:
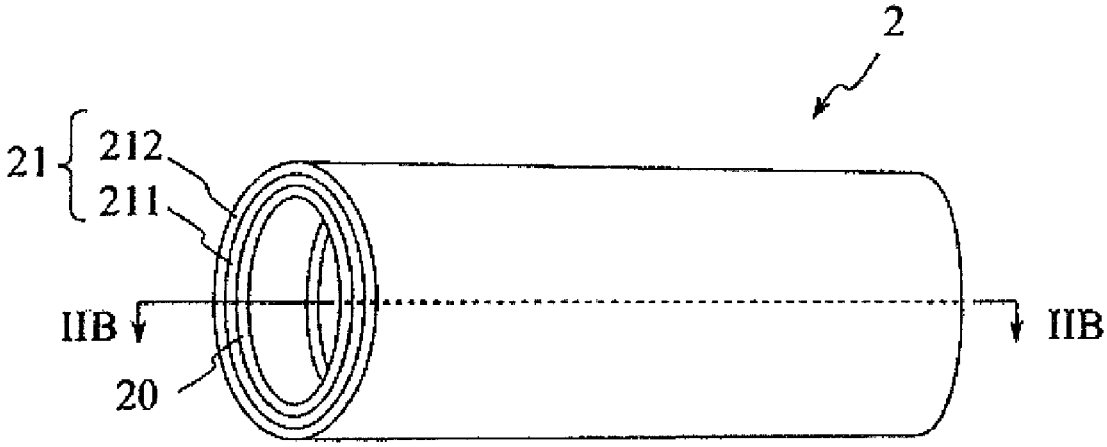
FIG. 2A is a perspective view showing a schematic configuration of an electrophotographic photosensitive body according to the first embodiment of the present invention.
Figure 2B:
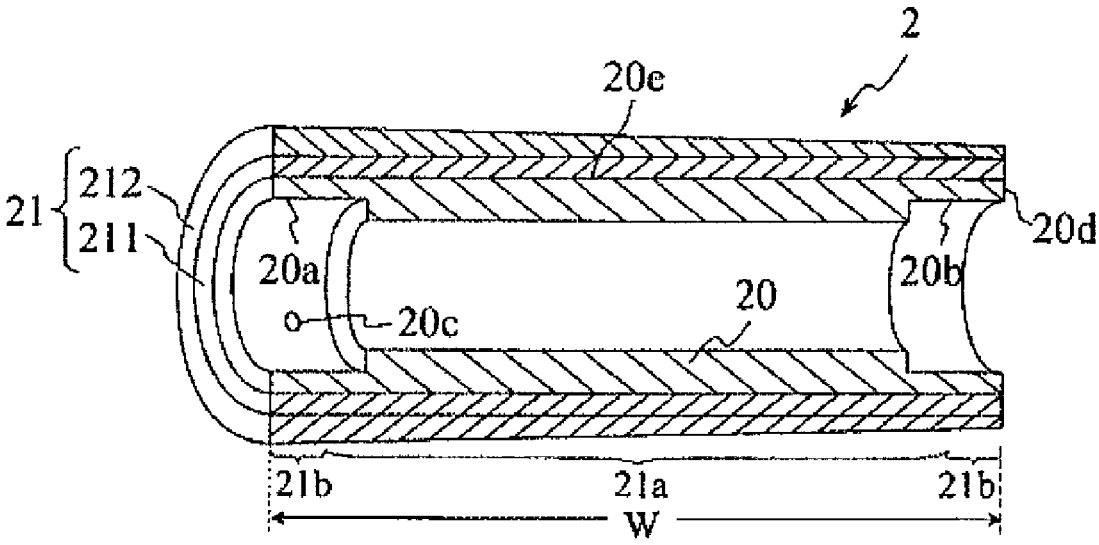
FIG. 2B is a perspective sectional view taken along a line IIB-IIB in FIG. 2A.
Figure 3:
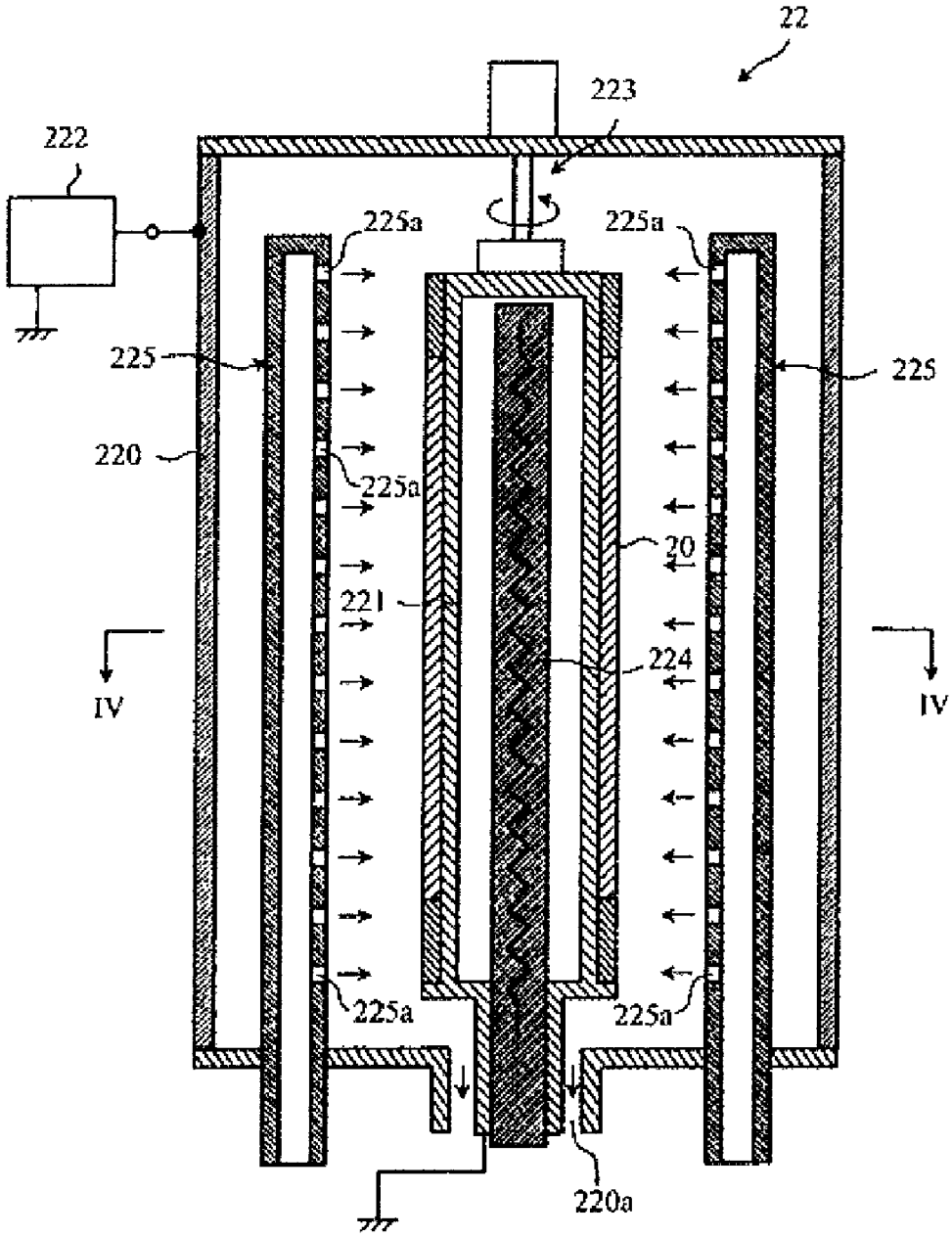
FIG. 3 is a view showing a schematic configuration of a glow discharge decomposition apparatus for manufacturing the electrophotographic photosensitive body shown in FIG. 2A.
Figure 4:
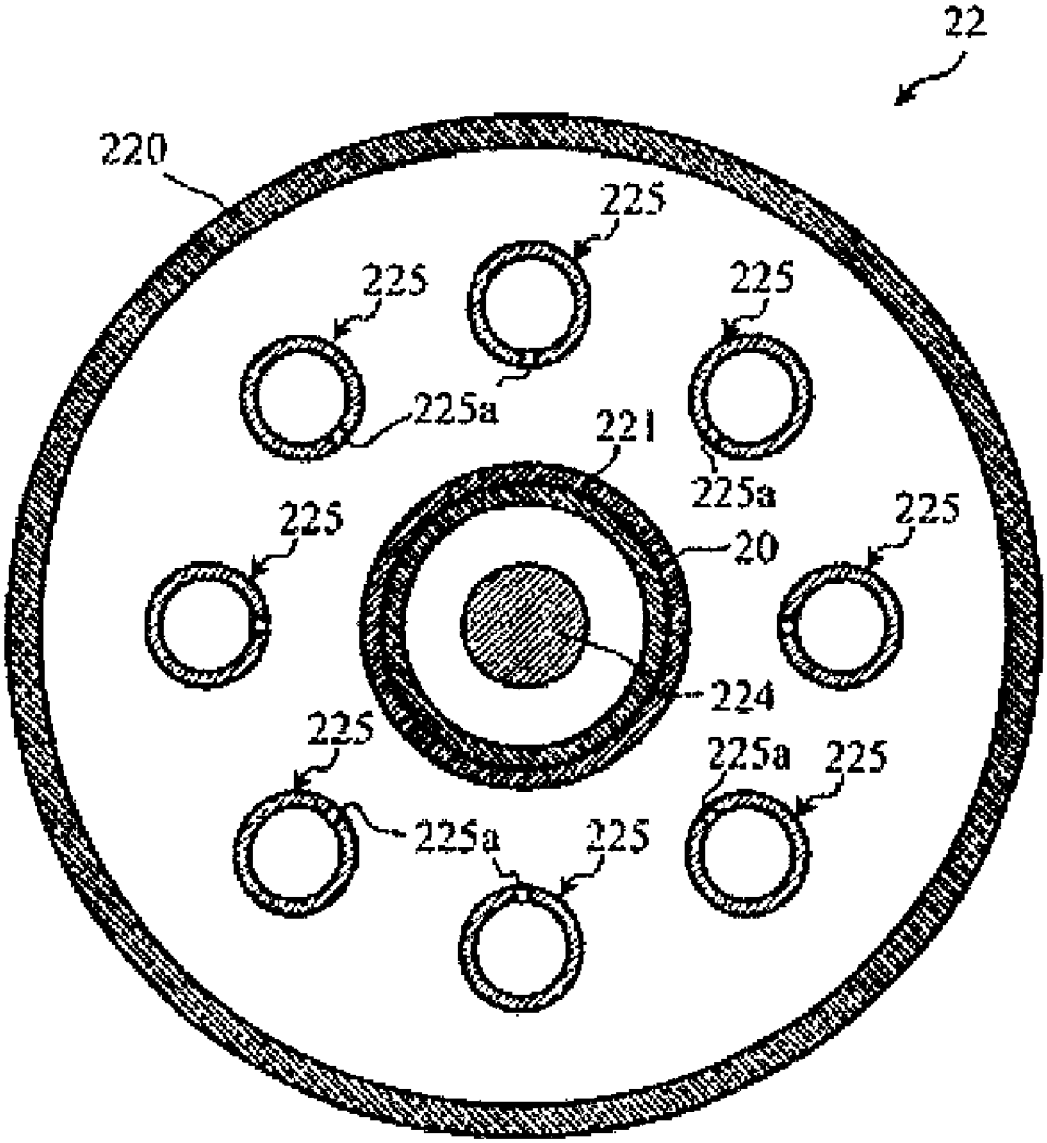
FIG. 4 is a sectional view taken along a line IV-IV in FIG. 3.
Figure 5:
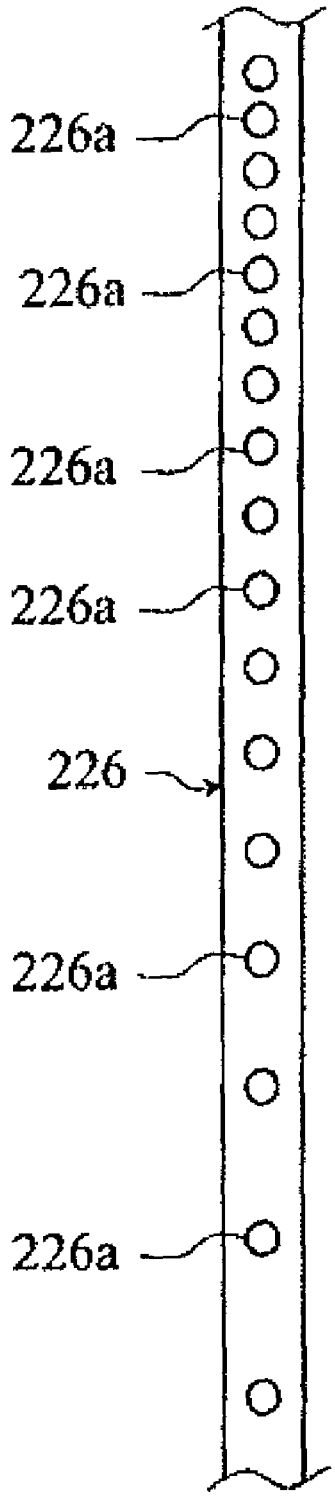
FIG. 5 is a front view showing a schematic configuration of a gas inlet pipe in the glow discharge decomposition apparatus shown in FIG. 3.
Figure 6:
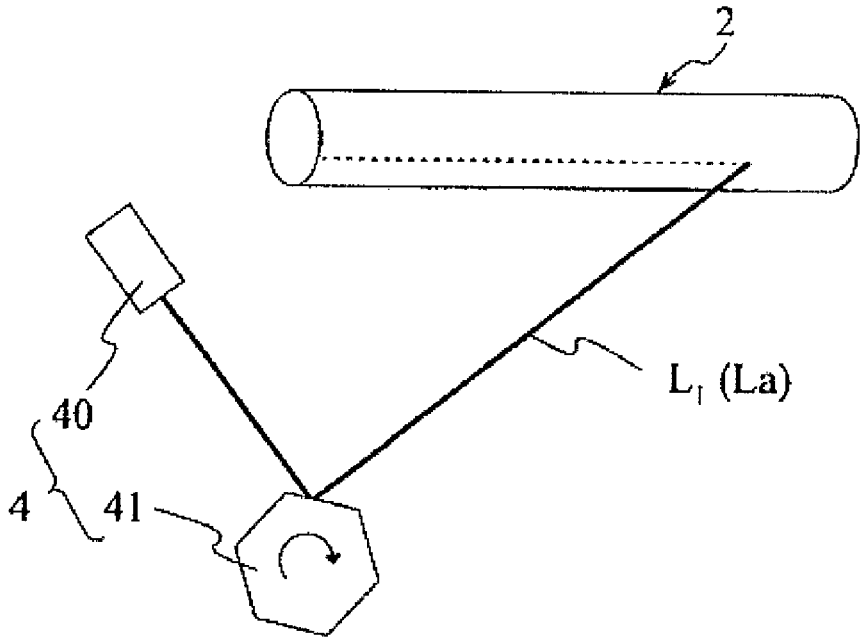
FIG. 6 is a view showing a schematic configuration of an exposure unit in the image forming apparatus shown in FIG. 1.
Figure 7:
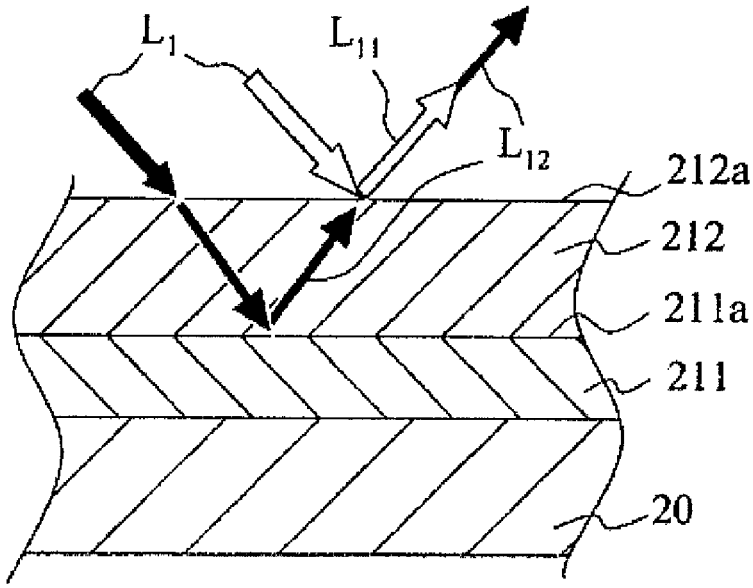
FIG. 7 is a schematic view for explaining a light interference state in a photosensitive layer of the electrophotographic photosensitive body shown in FIG. 2A.
Figure 8:
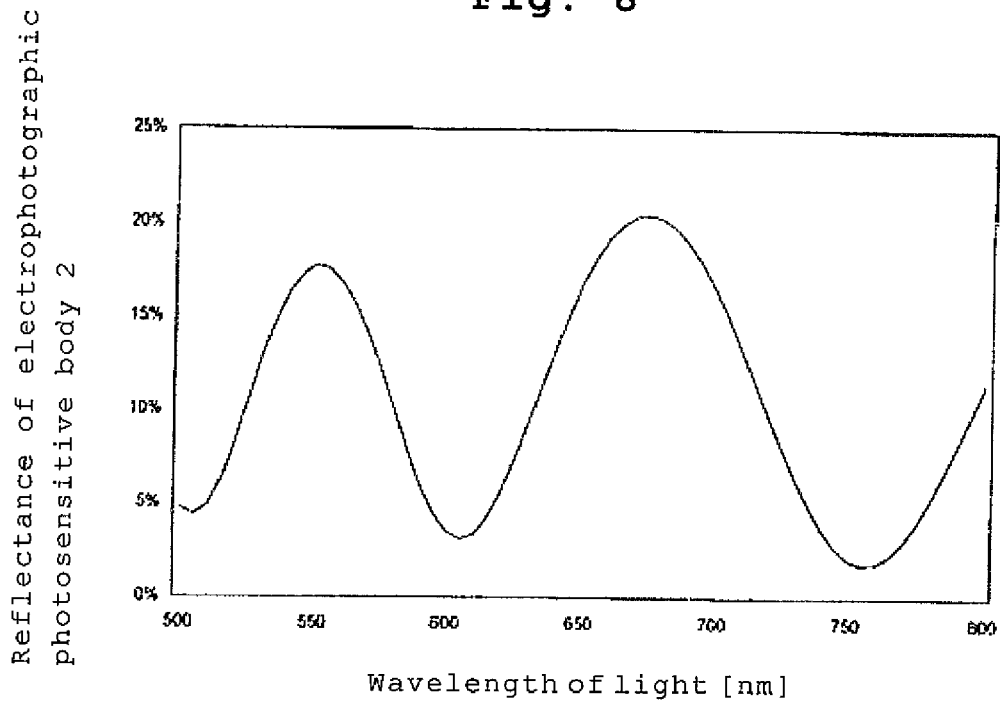
FIG. 8 is a view showing the result obtained by measuring, by an optical thickness gauge, a reflectance at the central part of the electrophotographic photosensitive body in the axial direction shown in FIG. 2A.
Figure 9:
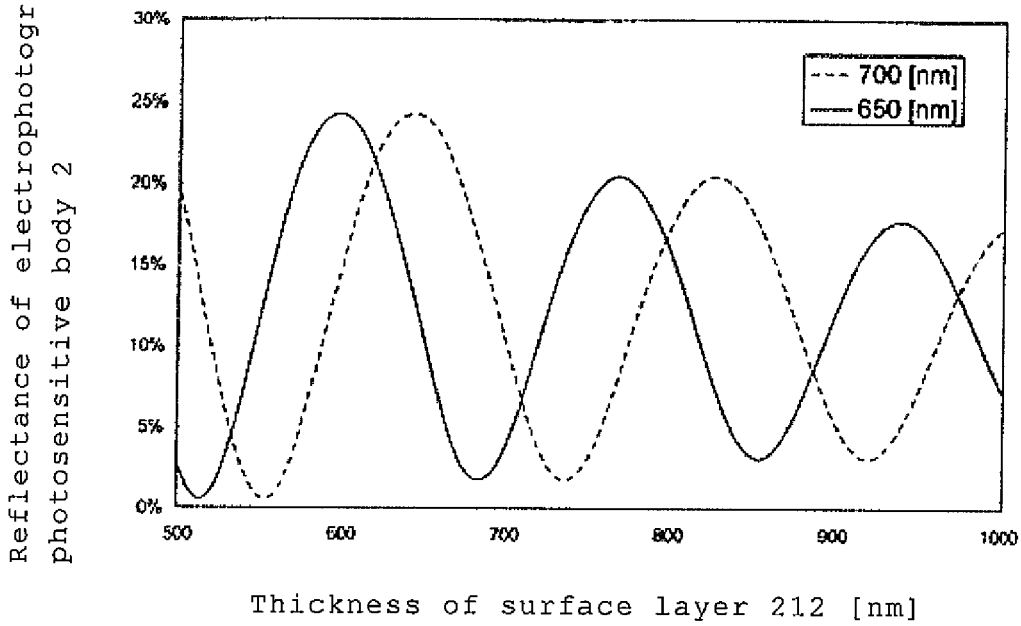
FIG. 9 is a view showing the result obtained by measuring, by an optical thickness gauge, a reflectance within a predetermined range of the electrophotographic photosensitive body shown in FIG. 2A in which the thickness of the surface layer is changed within the predetermined range.
Figure 10:
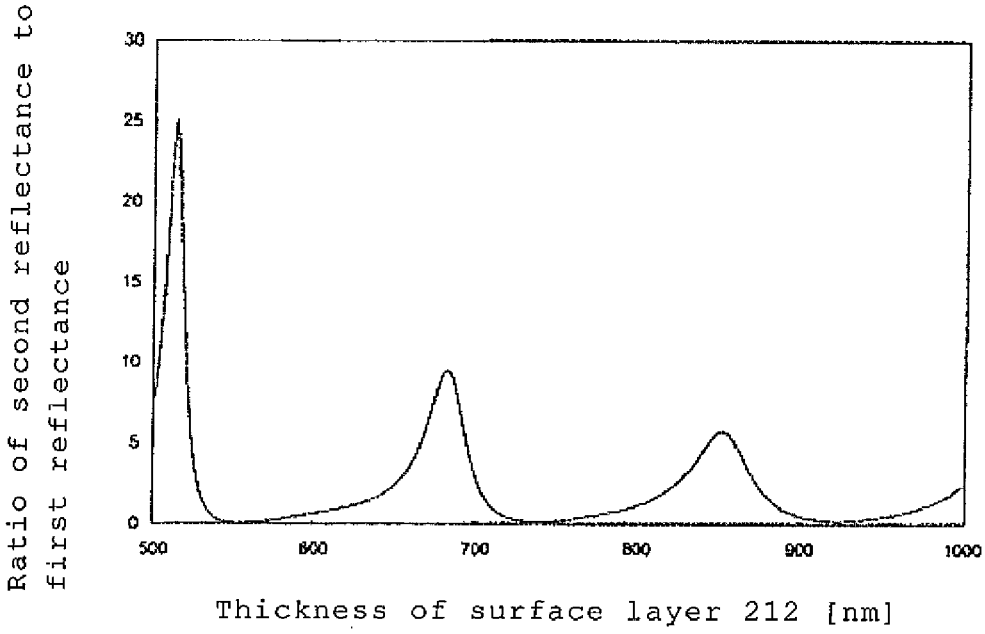
FIG. 10 is a view showing the result obtained by calculating the ratio of the reflectance of light having a wavelength of 650 nm to the reflectance of light having the wavelength of 700 nm from the result of the measurement in FIG. 9.
Figure 11:
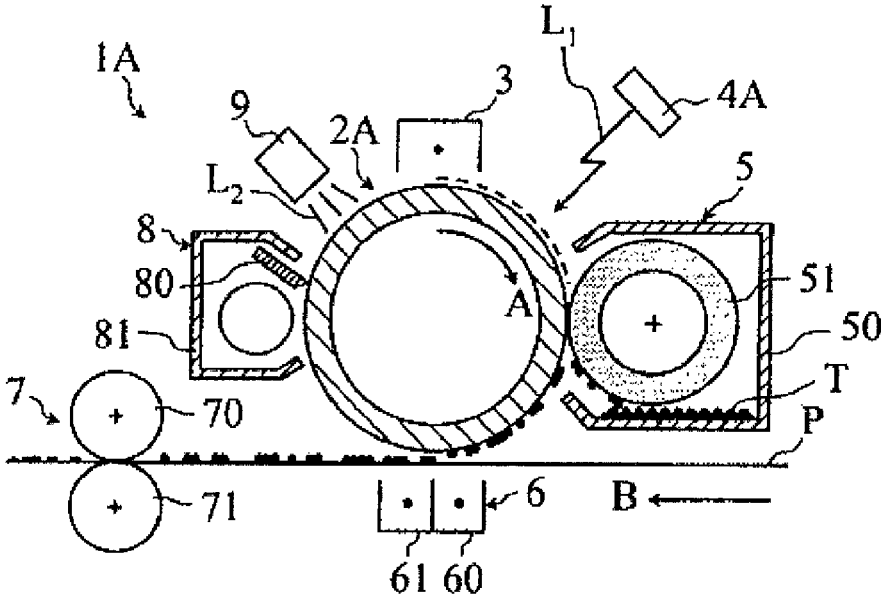
FIG. 11 is a view showing a schematic configuration of an image forming apparatus according to a second embodiment of the present invention.
Figure 12A:
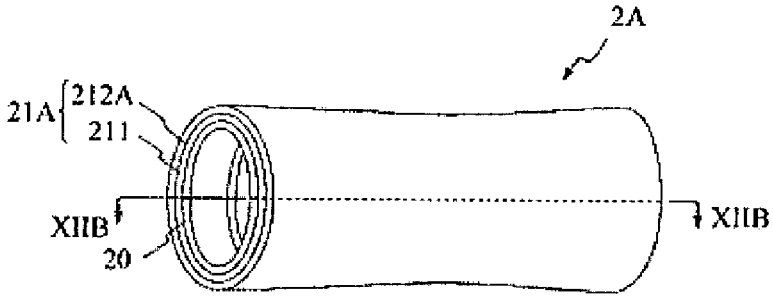
FIG. 12A is a perspective view showing a schematic configuration of an electrophotographic photosensitive body according to the second embodiment of the present invention.
Figure 12B:
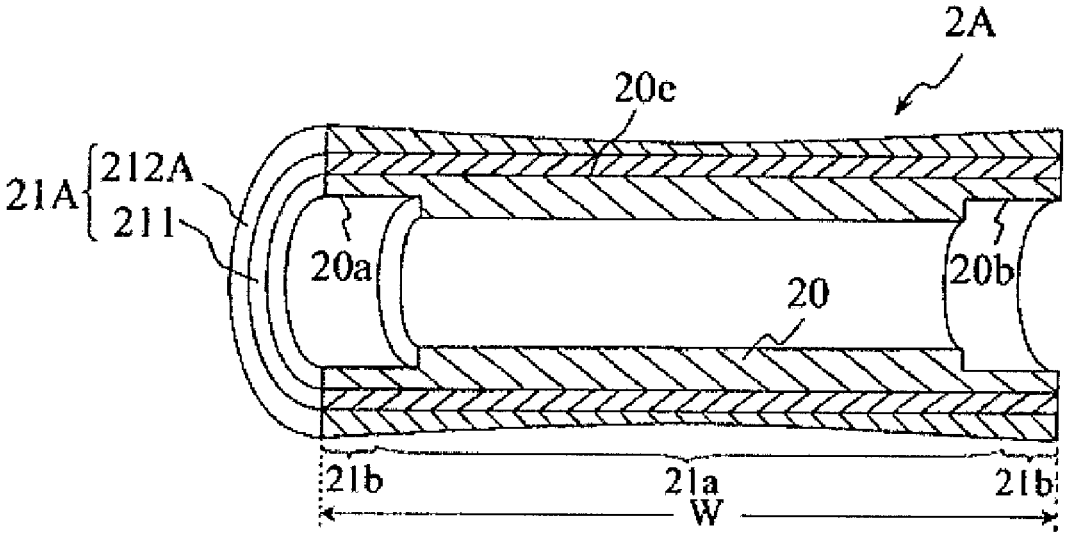
FIG. 12B is a perspective sectional view taken along a line XIIB-XIIB in FIG. 12A.
Figure 13:
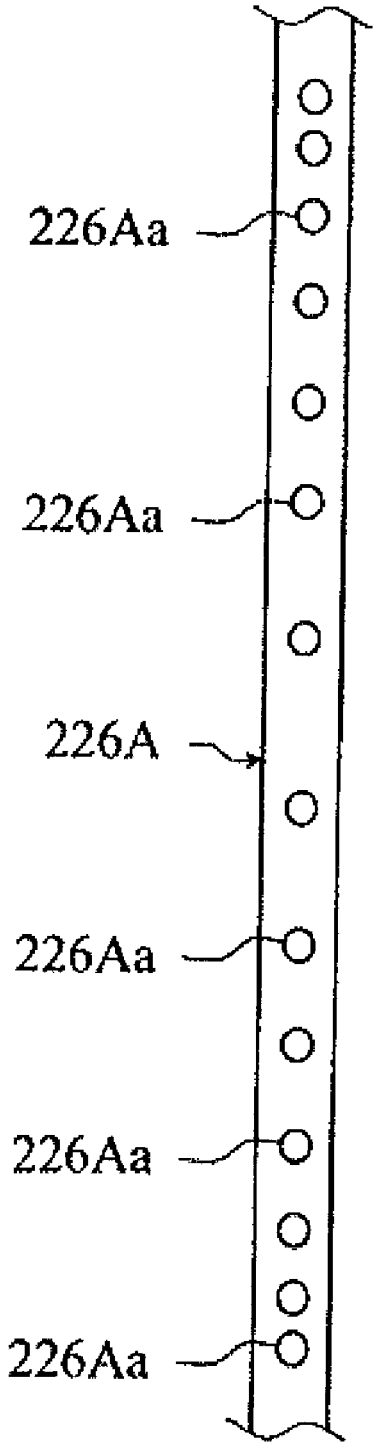
FIG. 13 is a front view showing a schematic configuration of a gas inlet pipe in the glow discharge decomposition apparatus for manufacturing the electrophotographic photosensitive body shown in FIG. 12A.
Figure 14:
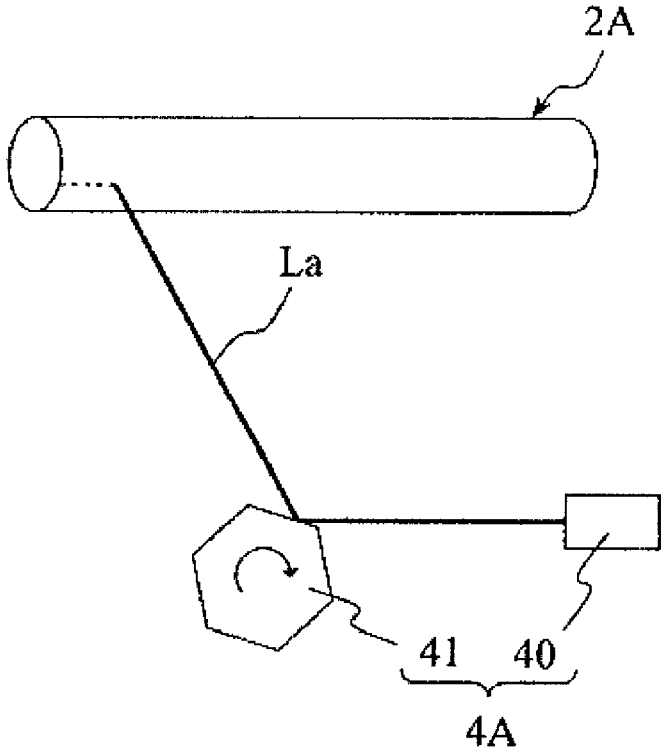
FIG. 14 is a view showing a schematic configuration of an exposure unit in the image forming apparatus shown in FIG. 11.
Figure 15:
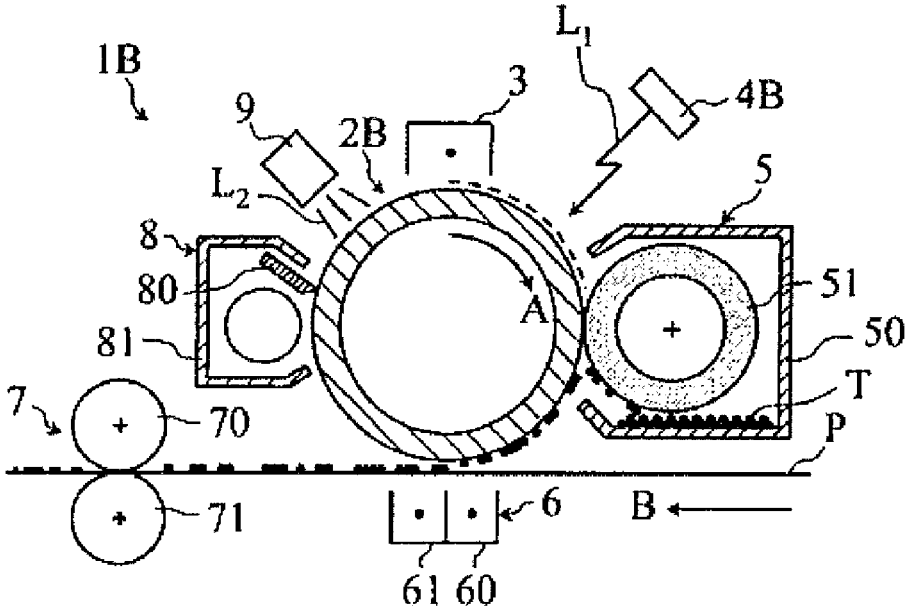
FIG. 15 is a view showing a schematic configuration of an image forming apparatus according to a third embodiment of the present invention.
Figure 16A:
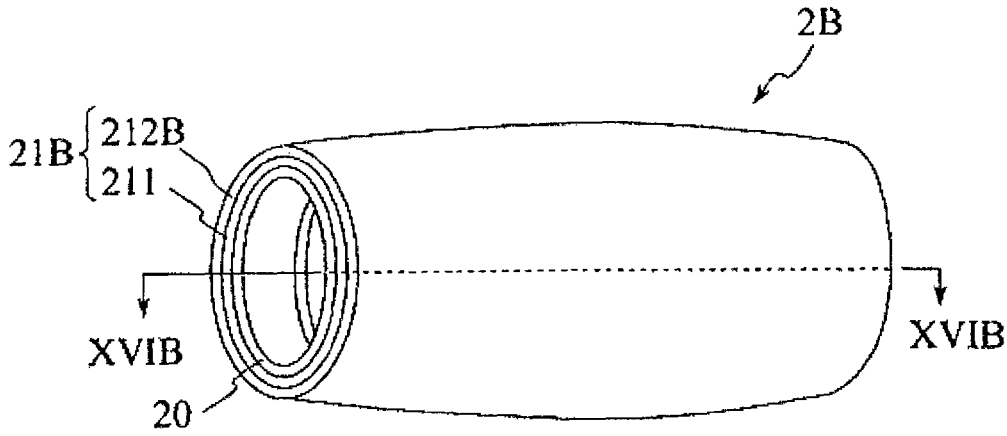
FIG. 16A is a perspective view showing a schematic configuration of an electrophotographic photosensitive body according to the third embodiment of the present invention.
Figure 16B:
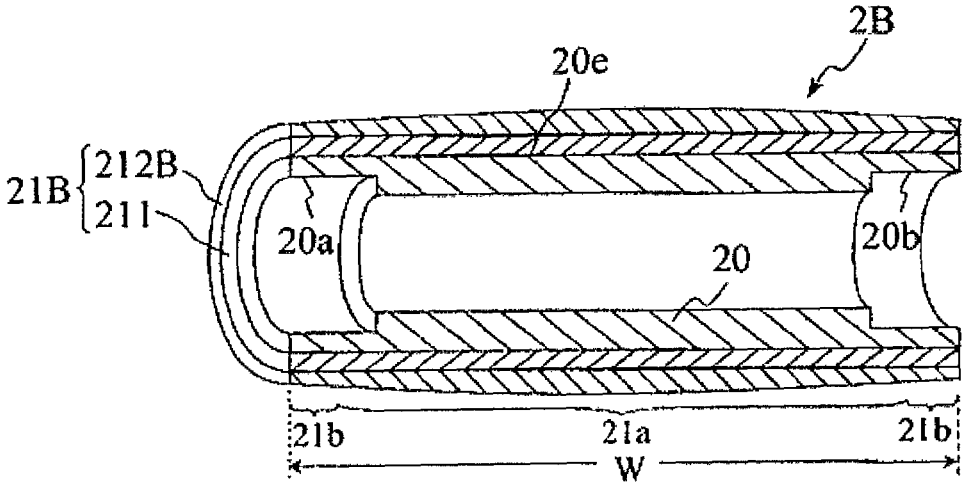
FIG. 16B is a perspective sectional view taken along a line XVIB-XVIB in FIG. 16A.
Figure 17:
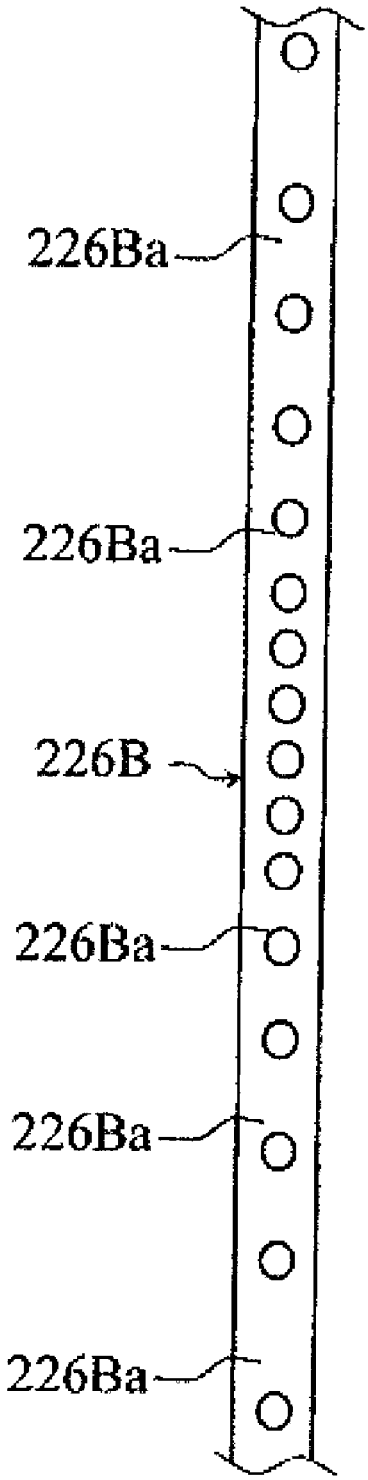
FIG. 17 is a front view showing a schematic configuration of a gas inlet pipe in the glow discharge decomposition apparatus for manufacturing the electrophotographic photosensitive body shown in FIG. 16A.
Figure 18:
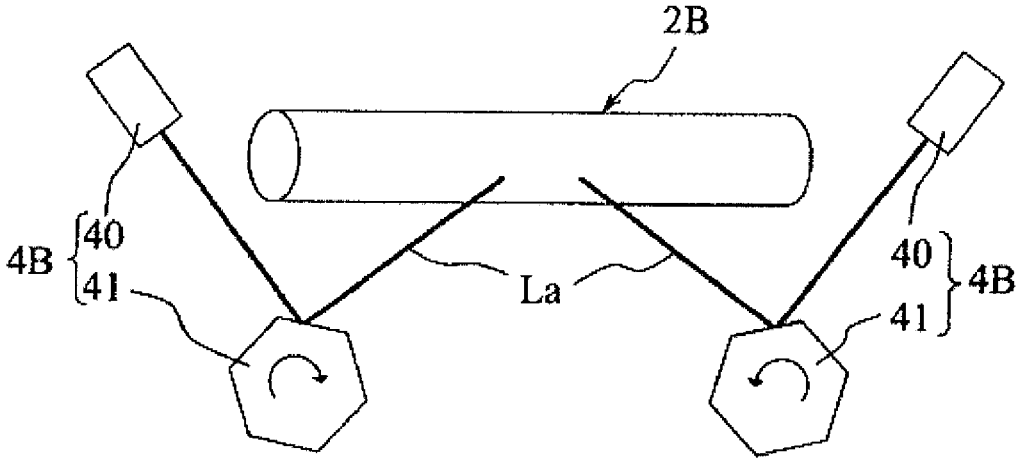
FIG. 18 is a view showing a schematic configuration of an exposure unit in the image forming apparatus shown in FIG. 15.
Figure 19:
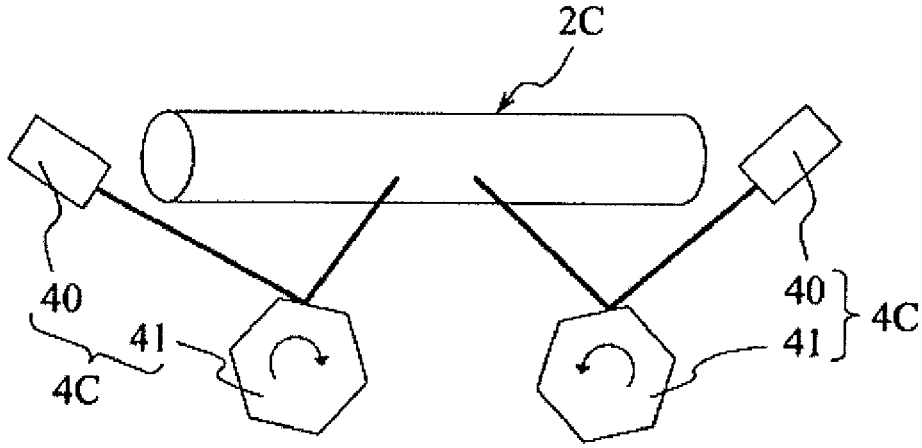
FIG. 19 is a view showing a schematic configuration of a modification of the exposure unit shown in FIG. 18.
Figure 20:
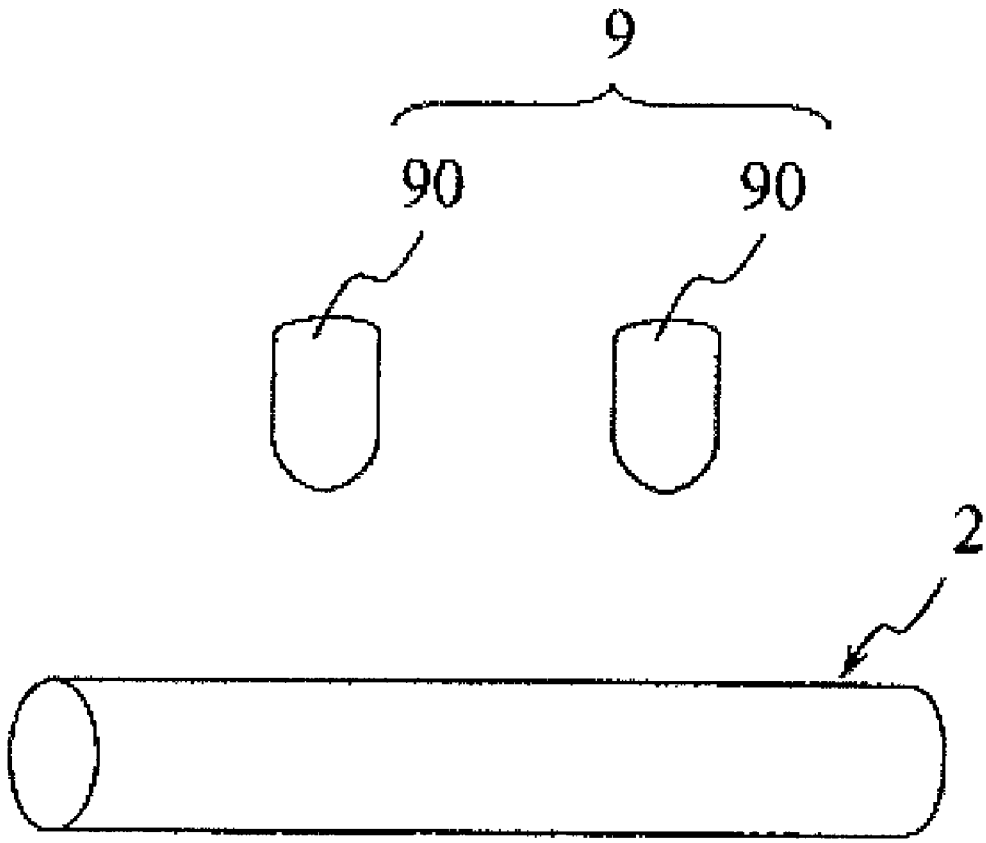
FIG. 20 is a view showing a schematic configuration of a modification of the static eliminating unit in the image forming apparatus shown in FIG. 1.

1, 1A, 1B Image forming apparatus
2, 2A, 2B, 2C Electrophotographic photosensitive body
20 Cylindrical substrate
21 Photosensitive layer
211 Photoconductor layer
212, 212A, 212B Surface layer
22 Glow discharge decomposition apparatus
220 Vacuum chamber
221 Substrate supporting member
222 High-frequency power supply
223 Rotating mechanism
224 Heater
225 Gas inlet pipe
226, 226A, 226B Gas inlet pipe
3 Charger
4, 4A, 4B, 4C Exposure unit
40 Light source
41 Scanning means
5 Developing unit
50 Case
51 Sleeve
6 Transfer unit
60 Transfer charger
61 Separation charger
7 Fixing unit
70, 71 Fixing roller
8 Cleaning unit
80 Blade
81 Case
9 Static eliminating unit
90 Light source
P Recording sheet

The invention claimed is:

1. An electrophotographic photosensitive body comprising a substrate and a photosensitive layer formed on the substrate, wherein, when a reflectance to an exposure light for forming an electrostatic latent image is defined as a first reflectance, and a reflectance to a eliminating light for eliminating charges constituting the electrostatic latent image is defined as a second reflectance, the first reflectance is positively correlated with a light intensity rate of the exposure light, and the second reflectance is positively correlated with the light intensity rate in a first case in which a ratio of an amount of change of the first reflectance to an amount of change of the light intensity rate is less than 1, while it is negatively correlated with the light intensity rate in a second case in which a ratio of an amount of change of the first reflectance to an amount of change of the light intensity rate is more than 1.

2. The electrophotographic photosensitive body according to claim 1, wherein the first reflectance becomes the maximum in a region where the light intensity rate becomes the maximum.

3. The electrophotographic photosensitive body according to claim 2, wherein, in the region where the light intensity rate becomes the maximum, the second reflectance becomes the maximum in the first case, while it becomes the minimum in the second case.

4. The electrophotographic photosensitive body according to claim 1, wherein the ratio of the second reflectance to the first reflectance is negatively correlated with the light intensity rate.

5. The electrophotographic photosensitive body according to claim 4, wherein the ratio of the second reflectance to the first reflectance becomes the minimum in the region where the light intensity rate becomes the maximum.

6. The electrophotographic photosensitive body according to claim 1, wherein the photosensitive layer includes a photoconductor layer and a surface layer, wherein the difference between the maximum value and the minimum value in an optical thickness of the surface layer is 0.25 or more times the wavelength of the exposure light and 0.25 or more times the wavelength of the eliminating light in the region where the electrostatic latent image is to be formed.

7. The electrophotographic photosensitive body according to claim 1, wherein the photosensitive layer includes a photoconductor layer and a surface layer, wherein the first reflectance and the second reflectance are adjusted according to the thickness of the surface layer.

8. An image forming apparatus comprising:

an electrophotographic photosensitive body according to claim 1;

a charger for charging the electrophotographic photosensitive body;

exposure means for emitting the exposure light; and eliminating means for emitting the eliminating light.

9. The image forming apparatus according to claim 8, wherein the exposure means has a light source that emits a laser beam as the exposure light.

* * * * *